US006575451B2

(12) United States Patent
Takai

(10) Patent No.: US 6,575,451 B2
(45) Date of Patent: Jun. 10, 2003

(54) SHEET FEEDER

(75) Inventor: Masanori Takai, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/893,936

(22) Filed: Jun. 27, 2001

(65) Prior Publication Data

US 2002/0000691 A1 Jan. 3, 2002

(30) Foreign Application Priority Data

Jul. 3, 2000 (JP) ..... 2000-201164

(51) Int. Cl.[7] ..... B65H 3/06
(52) U.S. Cl. ..... 271/119; 271/109; 271/113
(58) Field of Search ..... 271/119, 113, 271/109, 127

(56) References Cited

U.S. PATENT DOCUMENTS 4,635,922 A * 1/1987 Roetter et al. ..... 271/119
5,046,713 A * 9/1991 Cargill ..... 271/119
6,059,281 A * 5/2000 Nakamura et al. ..... 271/119
6,126,161 A 10/2000 Kato
6,135,444 A * 10/2000 Padget ..... 271/119

FOREIGN PATENT DOCUMENTS

JP 8-133504 5/1996

* cited by examiner

*Primary Examiner*—John M. Jillions
(74) *Attorney, Agent, or Firm*—Frishauf, Holtz, Goodman & Chick, P.C.

(57) ABSTRACT

A sheet feeder includes a cassette for containing a plurality of stacked sheets, a holding member for holding sheets from above, a pickup roller which contacts the uppermost sheet from above during one rotation, thereby feeding and transporting the uppermost sheet, a rotatable subsidiary holding member which is rotated in synchronization with a rotation of the pickup roller and in the same rotating direction as the pickup roller, and contacts and holds the sheets from above during each rotation before the pickup roller contacts the uppermost sheet. The distance between a rotation axis and that surface of the rotatable subsidiary holding member which contacts the uppermost sheet is equal to, or greater than the distance between a rotation axis and that surface of the pickup roller which contacts the sheet.

26 Claims, 4 Drawing Sheets

SHEET FEEDER

CROSS-REFERENCE TO RELATED APPLICATIONS

This application is based upon and claims the benefit of priority from the prior Japanese Patent Application No. 2000-201164, filed Jul. 3, 2000, the entire contents of which are incorporated herein by reference.

BACKGROUND OF THE INVENTION

1. Field of the Invention

This invention relates to a sheet feeder that is provided in an image forming apparatus.

2. Description of the Related Art

In an image forming apparatus such as a facsimile, printer, copy machine or the like, there is provided a sheet feeder that contains and feeds sheets for recording to an image recording section. Generally, the sheet feeder comprises a cassette, a holding member and a plurality of pickup rollers. The cassette contains a plurality of sheets stacked therein. The holding member holds the uppermost sheet of the sheets contained in the cassette from above. The pickup rollers are arranged at intervals on a rotation axis in a direction perpendicular to the direction of feeding the uppermost sheet. While the pickup rollers are kept in contact with the uppermost sheet during one rotation, the pickup rollers feed the sheet during one rotation. In other words, the holding member is a holding claw that holds a corner of the stacked sheets at the downstream side in the direction of transporting the uppermost sheet, and the pickup roller is a round cam. When a projection provided on the periphery of the pickup roller presses the uppermost sheet during the rotation of the pickup roller and locomotion is applied to the sheet toward the downstream side of the transporting with frictional force generated due to the pressing, the uppermost sheet separates from the holding member and is fed forwards. The fed sheet is carried to a transport roller that is provided at the downstream side of the transporting direction against the cassette, and further carried and fed to the image recording section by the rotation of the transport roller.

This kind of sheet feeder has a problem that will be described below.

Recently, it has been required that a cassette to be provided in a sheet feeder should have a large capacity in correspondence with acceleration of an image forming apparatus. The number of sheets that are stacked and contained in the cassette has been increased to four or five hundred, or more.

Meanwhile, if sheets are stacked to be contained in a cassette and left to stand, the sheets are deformed due to the influence of temperature or humidity in the cassette, with the result that a central portion of the sheets in a direction perpendicular to the transporting direction rises and becomes warped. In a case where the capacity of stacked sheets in a cassette is small (roughly 250 sheets or less), warps arising in the sheets are not so serious as to influence transportation precision. However, as described above, as the size of the cassette is enlarged and thus the number of sheets to be stacked and contained in the cassette is also increased (roughly 400 to 500 sheets or above, generally), warps of the sheet are increased and thus the influence on the transportation precision cannot be disregarded.

More specifically, for a case where 500 sheets of standard recording paper are stacked and left lying in the cassette, for example, an actual warp amount was 6 mm or more, under the conditions of high temperature and humidity such as the temperature is 30 degrees Celsius and humidity is about 85% and the sheets are left for three days. In general, when humidity is high, a warp is caused at the center portion of the sheet and the center portion rises. When he humidity is low, both ends of the sheet warp and rise. In this case, holding members hold both ends of the sheet, and the center portion of the sheet warp rise by about 3 mm.

FIG. 7 shows a warped sheet being transported by a conventional sheet feeder. In FIG. 7, P, 1 and 2 represent the warped sheet, pickup rollers and transport rollers, respectively. The sheet P having warps extending in the transporting direction at the center portion of the sheet P as viewed in the direction perpendicular to the transporting direction is fed in the direction of the arrow by means of pickup rollers 1 and transported by means of transport rollers 2. During this operation, warped portions of the sheet P are crushed. Therefore, unusual noise is generated from the sheet P. In addition, wrinkles and skews are caused in the sheet P when recording an image. As specifically shown in FIG. 7, when a transporting path from the pickup rollers 1 to the transport rollers 2 is curved at sharp angle, warps of the sheet P are crushed heavily. Therefore, each phenomenon as described above is caused markedly.

It is an object of the present invention to provide a sheet feeder that prevents various malfunctions from occurring, the malfunctions being caused due to warps to the sheet when the sheets stacked in the cassette are fed and transported.

BRIEF SUMMARY OF THE INVENTION

To achieve the above object, there is provided a sheet feeder comprising:

a cassette for containing a plurality of sheets stacked therein;

a holding member for holding the stacked sheets in the cassette from above;

at least one pickup roller arranged on a first rotation axis extending in a direction perpendicular to a transporting direction, in which the uppermost sheet is fed from the cassette and transported, said at east one pickup roller feeding and transporting the uppermost sheet while the pickup roller is kept in contact with the uppermost sheet during one rotation of the pickup roller; and a rotatable subsidiary holding member arranged on a second rotation axis extending in the direction perpendicular to the transporting direction, rotated in synchronization with a rotation of the pickup roller and in the same direction as the pickup roller rotates, and contacting the uppermost sheet from above to hold the warp of the sheets during one rotation of the rotatable subsidiary holding member before the pickup roller contacts the uppermost sheet.

Since the rotatable subsidiary holding member contacts and holds the uppermost sheet from above so as to suppress a warp caused in the stacked sheets before the pickup roller contacts and feeds the uppermost sheet, is possible to fed and transport the uppermost sheet in a state that the warp of the sheets has been suppressed.

According to a second aspect of the present invention, there is provided a sheet feeder wherein a distance between the second rotation axis of the rotatable subsidiary holding member and that surface of the rotatable subsidiary holding member which contacts the uppermost sheet is equal to, or greater than a distance between the first rotation axis of the pickup roller and that surface of the pickup roller which contacts the uppermost sheet.

Since the rotatable subsidiary holding member holds the sheets deeply, a warp caused to the sheets is suppressed.

According to a third aspect of the present invention, there is provided a sheet feeder wherein the rotatable subsidiary holding member is separated from the uppermost sheet during one rotation of the rotatable subsidiary holding member before the pickup roller is separated from the uppermost sheet.

The rotatable subsidiary holding remember can hold the sheets without hindering the pickup roller from feeding the sheets.

According to a fourth aspect of the present invention, there is provided a sheet feeder wherein the rotatable subsidiary holding member is made of a low-frictional material, and when the rotatable subsidiary holding member is in contact with the uppermost sheet, friction between the uppermost sheet and the rotatable subsidiary holding member is suppressed.

Since the friction between the rotatable subsidiary holding member and the sheets is suppressed, the rotatable subsidiary holding member can hold the sheets without hindering the pickup roller from feeding the sheets.

According to a fifth aspect of the present invention, there is provided a sheet feeder wherein two of the pickup rollers are arranged individually on both sides of the uppermost sheet as viewed in a direction of the first rotation axis, the first rotation axis and the second rotation axis are arranged identical with each other, and the rotatable subsidiary holding member is arranged between the two pickup rollers, so that the rotatable subsidiary holding member is arranged on a center portion of the uppermost sheet as viewed in a direction of the second rotation axis.

Normally, since a warp of the sheets occurs in the center portion of the sheets, the warp can be suppressed effectively with the rotatable subsidiary holding member arranged on the center portion of the uppermost sheet.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION

Now, the present invention will be described in detail by referring to the accompanying drawings. An embodiment of a sheet feeder will be described by referring to FIGS. 1 to 7. In the present embodiment, the sheet feeder that contains sheets such as sheets of recording paper stacked, and feeds the sheets successively to an image recording section, is applied to an image forming apparatus. The image forming apparatus adopts a system in that the sheet feeder is arranged horizontally, the image recording section is arranged horizontally above the feeder, and sheets fed out of the sheet feeder are U-turned and transported to the image recording section.

Figure 1:
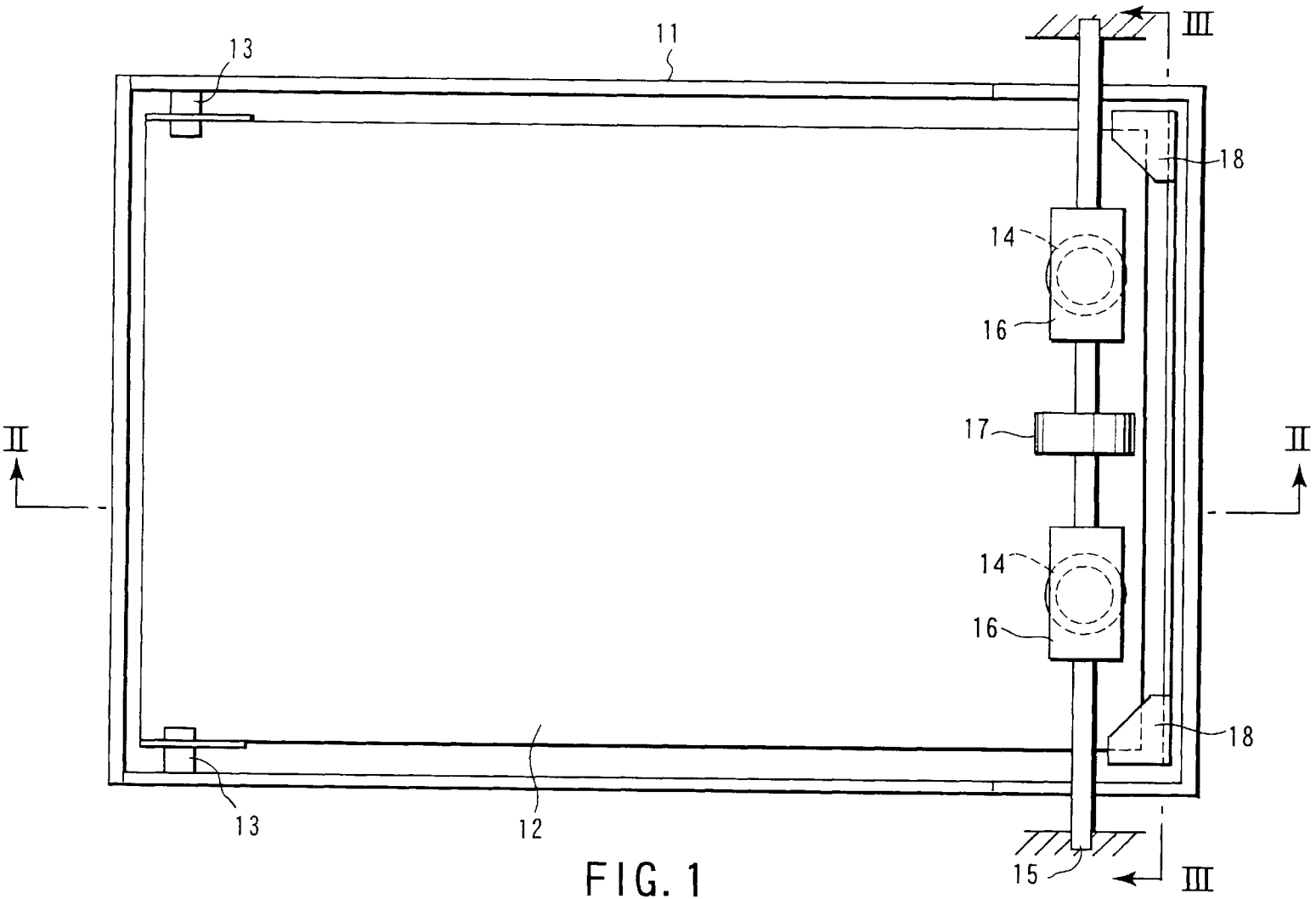
FIG. 1 is a plan view of a sheet feeder according to an embodiment of the invention.
Figure 2:
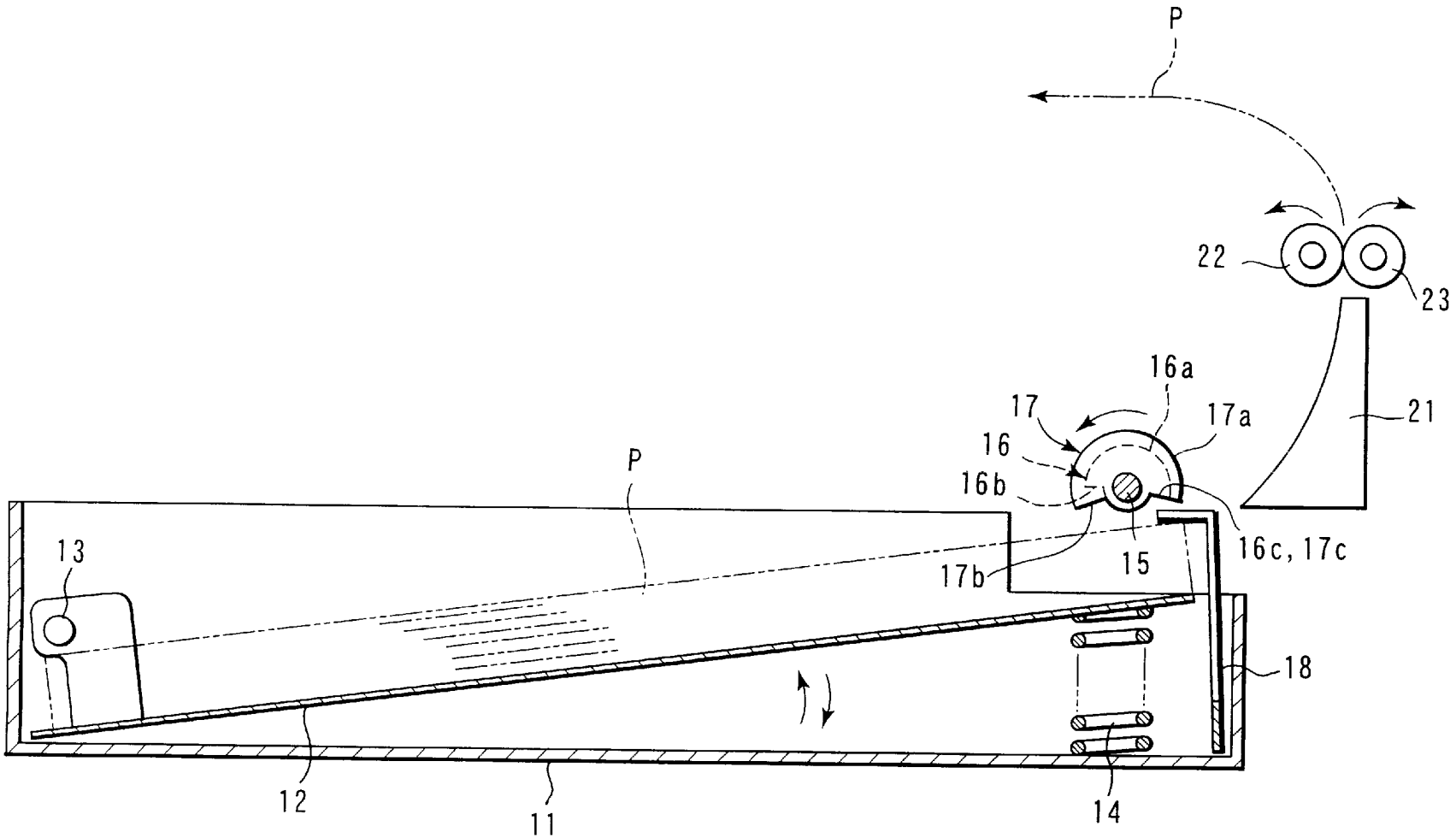
FIG. 2 is a cross-sectional view of the sheet feeder of the embodiment of the invention, taken along line II—II of FIG. 1.
Figure 3:
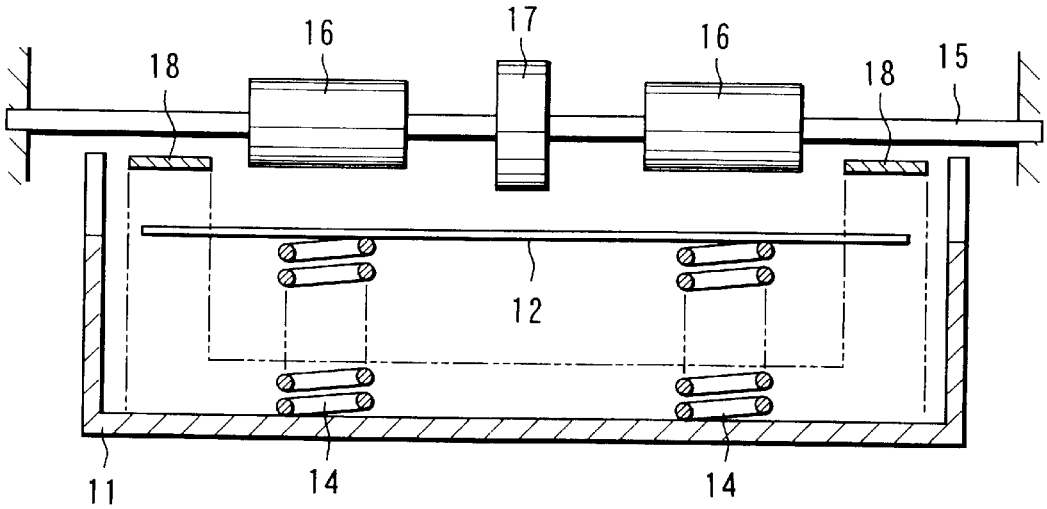
FIG. 3 is a cross-sectional view of the sheet feeder of the embodiment of the invention, taken along line III—III of FIG. 1.
Figure 4:
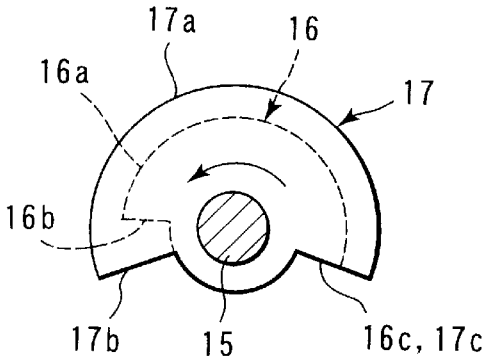
FIG. 4 is a side view showing a pickup roller and a rotatable subsidiary holding member provided in the sheet feeder of the embodiment of the invention.

FIGS. 1 to 3 illustrate a cassette 11 having a quadrangular box shape with an open top. The cassette 11 is horizontally arranged and removable from an image forming apparatus body (not shown). A mounting plate 12 formed by a quadrangular plate member is arranged in the cassette 11. In the mounting plate 12, both sides of an upstream end in a sheet transporting direction, which will be described later, are supported pivotally by means of a horizontal shaft 13 to the cassette 11, and thus the mounting plate 12 can be pivoted vertically. The mounting plate 12 is designed to multi-stack and lay sheets P such as recording paper consisting of cut paper thereon so as to contain the sheets in the cassette 11. A compressive coil spring 14 is arranged in the cassette 12 so as to support a downstream, end of the cassette 12 in the transporting direction from the lower side and constantly gives elasticity to push up.

At the upper side of the downstream end in the transporting direction in the cassette 11 that is arranged horizontally, a rotation-driving shaft 15 is arranged horizontally and extends in the direction perpendicular to the transporting direction. The rotation-driving shaft 15 is supported rotatably to the image forming apparatus body and rotated by means of a rotation-driving mechanism (not shown) provided in the image forming apparatus body in a direction toward an arrow mark in FIG. 2. A pair of pickup rollers 16 is mounted to the rotation-driving shaft 15. That is, the pickup rollers 16 are arranged at intervals on a first rotation axis extending in a direction perpendicular to the transporting direction. As a result, the paired pickup rollers 16 are arranged on the both sides of the downstream end of the sheets P in the transporting direction. The sheets P are stacked and laid on the mounting plate 12. The longer sides extend in the direction perpendicular to the transporting direction. The paired pickup rollers 16 are rotated by a rotation of the rotation-driving shaft 15. At every rotation of the pickup rollers 16, each outer circumferential surface 16*a* of the pickup rollers 16 contacts the uppermost sheet of stacked sheets P from above, while the pickup rollers 16 are rotated. The pickup rollers 16 transport the uppermost sheet to the downstream side as viewed in the transporting direction of the sheets by their rotation and the pickup rollers 16 then are separated from the uppermost sheet. While the pickup rollers 16 are in contact with the uppermost sheet, the pickup rollers 16 separate the uppermost sheet from stacked sheets P and feed the separated sheet so as to transport the separated sheet to the downstream side as viewed in the transporting direction of the sheets. Each pickup roller 16 includes a round cam. Each pickup roller 16 has an outer circumferential surface 16*a*, which has necessary length in a circumferential direction to separate the uppermost sheet from the stacked sheets P, and transport the separated sheet to transport rollers 22 (will be described later). The outer circumferential surface 16*a* is designed to have a fan form sandwiched between a leading end 16*b* placed at the front side as viewed in the rotating direction and a terminal end 16*c* placed at the back side. The length of the outer circumferential surface 16*a* in the circumferential direction is equal to a sum of a distance between the pickup roller 16 and transport roller 22, and a certain margin length.

A rotatable subsidiary holding member 17 is mounted rotatably to the rotation-driving shaft 15. In other words, the first rotation axis where the pickup rollers 16 are arranged and a second rotation axis where the rotatable subsidiary holding member 17 are arranged identical with each other. The rotatable subsidiary holding member 17 is arranged at the middle between two of the pickup rollers 16. Therefore, the rotatable subsidiary holding member 17 is arranged on the center portion of the uppermost sheet of the sheets P as viewed in a direction of the rotation axis. The rotatable subsidiary holding member 17 is positioned on the downstream end of the center portion as viewed in the transporting direction. The sheets P are stacked and laid on the mounting plate 12. The rotatable subsidiary holding member 17 is rotated by a rotation of the rotation-driving shaft 15 in synchronization with rotations of the pickup rollers 16. At every time of rotating, the rotatable subsidiary holding member 17 contacts and holds the uppermost sheet of stacked sheets P from above prior to the contact of the pickup rollers 16 with the sheet. The rotatable subsidiary holding member 17 then may be separated from the sheet before the pickup rollers 16 are separated from the sheet. Accordingly, a warp caused at the center portion of the stacked sheets P can be suppressed and leveled, and the uppermost sheet can be fed and transported. In the present embodiment, the rotatable subsidiary holding member 17 is separated from the uppermost sheet at the same time as the pickup rollers 16 are separated from the sheet.

The rotatable subsidiary holding member 17 is formed by a round cam that has an outer circumferential surface 17*a* including necessary length in a circumferential direction to separate the uppermost sheet from the stacked sheets P, fed to transport the separated sheet. The outer circumferential surface 17*a* is designed to have a fan form sandwiched between a leading end 17*b* placed at the front side as viewed in the rotating direction and a terminal end 17*c* placed at the back side. The leading end 17*b* is placed in front of the leading end 16*b* of the pickup roller 16 in the rotating direction.

The outer circumferential surface 17*a* of the rotatable subsidiary holding member 17, which contacts the uppermost sheet, is formed to have a radius R1 of constant distance from the rotation-driving shaft 15 (the second rotation axis). On the other hand, each outer circumferential surface 16*a* of the pickup rollers 16 is formed to have a radius R2 of constant distance from the rotation-driving shaft 15 (the first rotation axis). The radius R1 is equal to, or greater than the radius R2. ($R1 \geqq R2$, in fact, $R1 > R2$ is adopted to this embodiment.) In other words, the distance between the second rotation axis of the rotatable subsidiary holding member 17 and that surface of the member 17 which contacts the uppermost sheet is equal to, or greater than the distance between the first rotation axis of the pickup rollers 16 and that surface of the pickup rollers 16 which contacts the uppermost sheet. The reason for this structure is that, if the radius R1 of rotatable subsidiary holding member 17 is smaller than the radius R2 of each pickup roller 16 ($R1 < R2$), the rotatable subsidiary holding member 17 cannot sufficiently hold the warp caused at the center portion of the sheets P. Note that the maximum of radius R1 is determined so that the rotatable subsidiary holding member 17 does not impose a load on the pickup rollers 16 to transport the uppermost sheet (the load depends on the difference between radius R1 and radius R2). According to this structure, since the rotatable subsidiary holding member 17 holds the sheets P deeply, the rotatable subsidiary holding member 17 can reliably suppress a warp residing in the sheets P.

The rotatable subsidiary holding member 17 is made of a low-frictional material, for example, a material having a soft surface such as synthetic resins, metal, or the like. Therefore, the friction of the rotatable subsidiary holding member 17 against the sheets P can be suppressed. As a result, the holding member 17 can hold the sheets P without hindering the pickup rollers 16 from feeding the uppermost sheet.

At both sides of downstream end of the cassette 11 as viewed in the transporting direction of sheets, a pair of claw members 18 as an example of holding members are provided respectively. Each claw member 18 receives and holds both corners of the mounting plate 12 and sheets P stacked on the plate 12 from above.

The sheet feeder is designed as described above. In the image forming apparatus body, a transporting guide 21 which guides the sheets P upward so as to U-turn the sheets P fed out of the downstream end of the cassette 11 as viewed in the transporting direction of sheets. The sheets, thus guided, are made to move in the transporting direction. A pair of transport rollers 22 and 23 that transport the sheets P are provided above the transporting guide 21. Each rotation axis of the transport rollers 22 and 23 extends in parallel with the rotation-driving shaft 15. One of the transporting rollers is rotated in the same direction as the rotation-driving shaft 15 by means of a rotation-driving mechanism (not shown) provided in the image forming apparatus body.

An operation of the sheet feeder now will be described. A user pivots the mounting plate 12 in a downward direction against power of the compressive coil spring 14 and stacks sheets, four to five hundred sheets for example, on the mounting plate 12. After that, the user has the mounting plate 12 pushed up and pivoted upward using the power of the compressive coil spring 14. Both corners of the downstream end of the uppermost sheet of stacked sheets P as viewed in the transporting direction, are held from above by means of the claw members 18, and thus the mounting plate 12 is prevented from pivoting upward. Under this state, sheets P are stacked and contained in the cassette 11.

The rotation-driving shaft 15 is rotated so that the pickup rollers 16 are rotated in a direction of the arrow in FIG. 2. While the pickup rollers 16 practice one rotation, each outer circumferential surface 16*a* at the side of leading end 16*b* contacts the uppermost sheet of the sheets P stacked on the mounting plate 12 from above and further moves the uppermost sheet toward the downstream side as viewed in the transporting direction together with the rotation of the pickup rollers 16. After that, by the time when the terminal end 16*c* is separated from the uppermost sheet, the outer circumferential surface 16*a* separates the uppermost sheet from the stacked sheets P and fed out for transportation. As described above, at every one rotation of the pickup rollers 16, while the pickup rollers 16 are rotated, kept in contact with the uppermost sheet, the pickup rollers 16 separate the uppermost sheet from the stacked sheets P and transport the sheet from the cassette 11 to the downstream side as viewed in the transporting direction. The fed sheet P is guided upward along the transporting guide 21 to the transport rollers 22 and 23, passed through between the rotating transport rollers 22 and 23, and further transported to be U-turned, thereby being fed to the image recording section.

Now, an operation of the rotatable subsidiary holding member 17 will be described. When a large number of sheets P are stacked on the mounting plate 12 and contained in the cassette 11, due to the influence of temperature or humidity, there arises a warp that is serious enough to affect transportation precision at the center port-on as viewed in a perpendicular direction to the direction of transporting the sheets P. The rotatable subsidiary holding member 17 is rotated in synchronization with rotation of the pickup rollers 16 and in the same direction as one of the pickup rollers 16 by means of the rotation-driving shaft 15. Prior to the contact of each leading end 16*b* of pickup rollers 16 with the uppermost sheet of the stacked sheets, the leading end 17*b* of rotatable subsidiary holding member 17 contacts the uppermost sheet from above. As the rotatable subsidiary holding member 17 rotates, the outer circumferential surface 17*a* contacts the uppermost sheet to hold the center portion of the sheets P downward. In other words, the outer circumferential surface 17*a* of rotatable subsidiary holding member 17 holds a warp in the center of the sheets P from above and transforms the warp downward to level the warp portion. Accordingly, the warp in the center portion of the sheet is eliminated and thus the entire sheet P becomes level.

After this operation, the pickup rollers 16 contact the uppermost and rotate to transport the uppermost sheet. While rotating in synchronization with the pickup rollers 16, the rotatable subsidiary holding member 17 presses the warp in the center of the sheets P prior to the Dickup rollers 16. In other words, the rotatable subsidiary holding member 17 prepares to suppress the warped portion of the sheets P for the pickup rollers 16 without hindering the pickup rollers 16 from feeding out and transporting the uppermost sheet. In the present embodiment, the rotatable subsidiary holding member 17 holds the sheets P deeper than that the pickup rollers 16 do so and thus, the warp residing in the sheets P can be reliably suppressed. As a result, the sheet P can be fed out from the cassette 11 in a state that the warp of the sheet is suppressed and the sheet becomes level, moved along the transporting guide 21, and transported between the transport rollers 22 and 23.

After the rotatable subsidiary holding member 17 is rotated and the terminal end 17*c* thereof reaches the uppermost sheet, the outer circumferential surface 17*a* is separated from the uppermost sheet. At the same time, after the pickup rollers 16 are rotated and the terminal end 16*c* thereof reaches the uppermost sheet, the outer circumferential surface 16*a* is separated from the uppermost sheet. In other words, from the time when the rotatable subsidiary holding member 17 contacts the uppermost sheet to the time when the pickup rollers 16 are separated from the sheets P, the rotatable subsidiary holding member 17 keeps contacting the uppermost sheet. Therefore, while the pickup rollers 16 are kept in contact with the uppermost sheet, the rotatable subsidiary holding member 17 keeps suppressing the warped portion of the sheets P. Thus, the rotatable subsidiary holding member 17 can contribute to the transportation of the uppermost sheet that are in the level state for a long time. In addition, since the rotatable subsidiary holding member 17 does not hinder the transportation of the uppermost sheet. As described above, while rotating, the rotatable subsidiary holding member 17 contacts and holds the uppermost sheet to suppress the warp at every rotation before the pickup rollers 16 contact the uppermost sheet, and the rotatable subsidiary holding member 17 is separated from the uppermost sheet at the same time the pickup rollers 16 are separated from the uppermost sheet.

Figure 5:
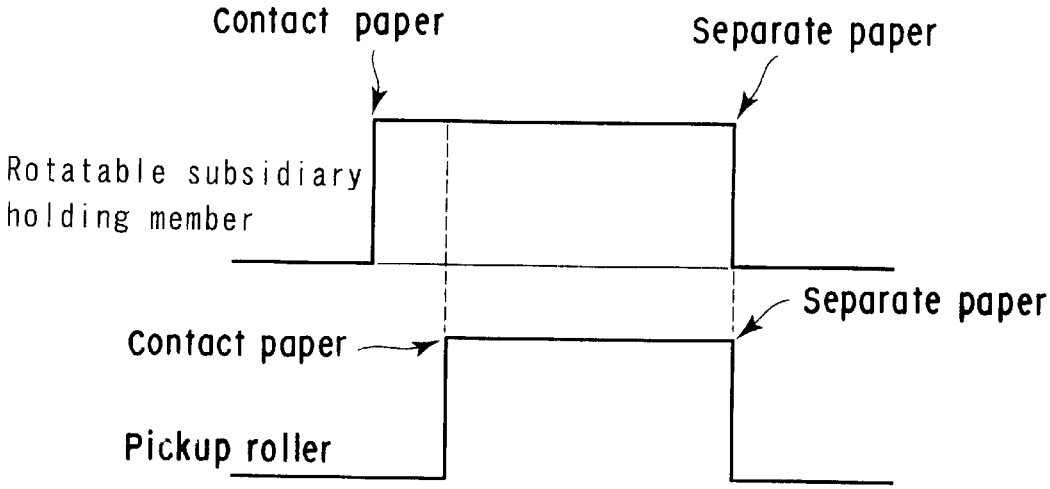
FIG. 5 is a time chart showing operations of the pickup roller and rotatable subsidiary holding member provided in the sheet feeder of the embodiment of the invention.

FIG. 5 is a time chart for explaining operations of the rotatable subsidiary holding member 17 and the pickup rollers 16.

In this manner, the sheets P can be fed out of the cassette 11 in a state where the warp in the sheets P is suppressed and the sheets become level, and transported to the transporting rollers. Thus, when the sheet is transported, it is possible that unusual noise generated by a warp, a wrinkle of the sheet, or the transportation of the sheet skewed is avoided. In order to U-turn and transport the sheet P fed out of the cassette 11 to the image forming section, a transporting path directed by the transporting guide 21, from the pickup rollers 16 to the transport rollers 22, is curved at a sharp angle. If the sheet P has a warp, the warped portion is crushed heavily in a transportation of the sheet having the warp along the sharply curved path. Therefore, problems such as the aforementioned unusual noise or the like become more serious. In the sheet feeder according to the present embodiment, since a warp of the sheets can be suppressed, this kind of problem can be avoided.

Figure 6:
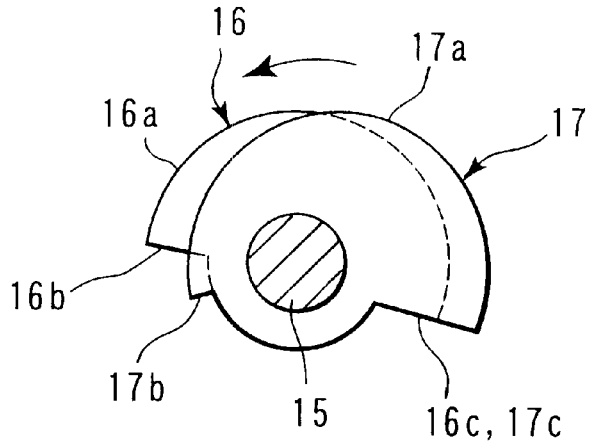
FIG. 6 is a side view showing a modification of the rotatable subsidiary holding member.
Figure 7:
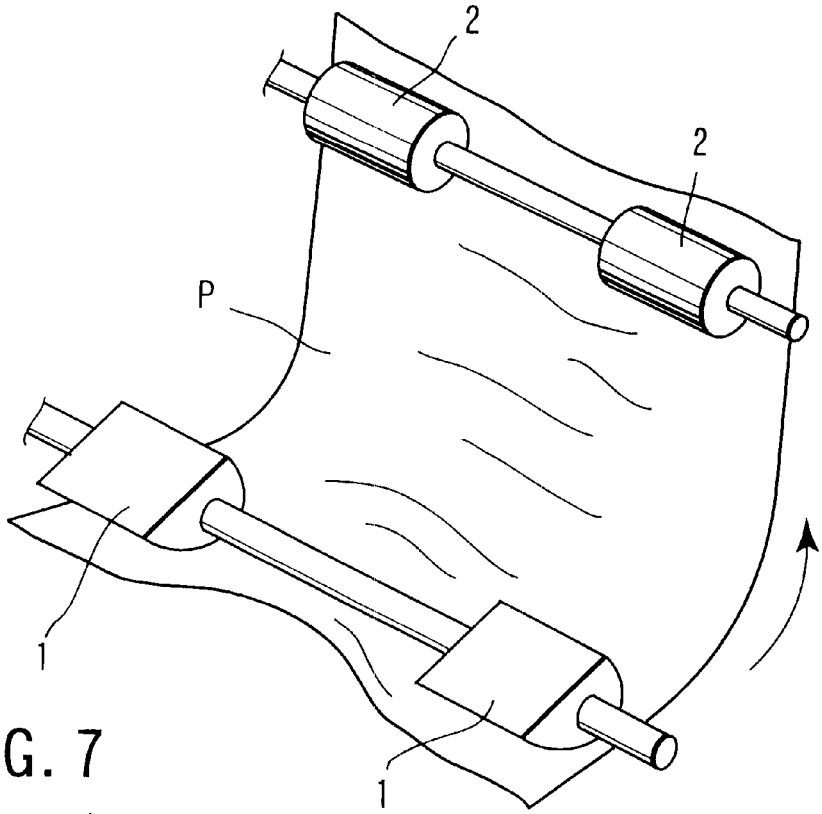
FIG. 7 Prior art
FIG. 7 shows how a warped sheet is transported using a conventional sheet feeder.

FIG. 6 shows a modification of the rotatable subsidiary holding member 17. The distance between the outer circumferential surface 17*a* and the rotation axis the first rotation axis, the second rotation axis) of the rotation-driving shaft 15 is increased gradually as it goes along the outer circumferential surface 17*a* from the leading end 17*b* to the terminal end 17*c*. As described above, the distance between the outer circumferential surface 16*a* and the rotation axis of the rotation-driving shaft 15 is constant. In other words, the outer circumferential surface 16*a* exists on the circumference of a circle having the radius R2. The distance between a portion of the outer circumferential surface 17*a* that contacts the leading end 17*b* and the rotation axis of the rotation-driving shaft 15 is smaller than the radius R2. According to the modified structure, the aforementioned advantage can be obtained.

The present invention is not limited to the aforementioned embodiment but can also be modified variously. A rotatable subsidiary holding member is not limited to the structure in that a portion to contact and hold the uppermost sheet and a portion to be separated from the sheet are separated in a circumferential direction as in the case of the round cam described in the aforementioned embodiment. Both portions are integrated with each other. That is, it is acceptable if some portion of the rotatable subsidiary holding member contacts and holds the uppermost sheet from above, before the pickup rollers contact the uppermost sheet at every and during a rotation of the rollers. In a case where a portion to contact the uppermost sheet and a portion to be separated from the sheet in the rotatable subsidiary holding member are separated in the circumferential direction, the rotatable subsidiary holding member is not limited to the structure in which a portion connecting with both of the portions is formed continuously so that the connecting portion contacts the uppermost sheet continuously. For example, a structure including only both portions so that only the portions contact the sheet, or a structure connecting both of the portions intermittently so that the connecting portion contacts the sheet intermittently is acceptable. In the present embodiment, the sheet feeder is applied to the image forming apparatus. Assuming a sheet of recording paper to be a sheet, the sheet is fed out and fed to the image forming section. However, the application of the sheet feeder in the present invention to the image forming apparatus is not limited of the above scheme. For example, assuming a medium on which an image is drawn to be a sheet, it is acceptable that the Tedium may be fed out and fed to aft image reading section.

When sheets stacked in a cassette are fed out and transported, the rotatable subsidiary holding member is rotated in synchronization with the rotation of the pickup rollers. During the rotation, the rotatable subsidiary holding member holds the sheets from above to hold a warp caused in the sheets before the pickup rollers contact the uppermost sheet. Accordingly, the sheets can be fed out and transported in a state where the sheets are leveled with the warp suppressed. Thus, it is possible that unusual noise caused by a warp that is generated when the sheet is transported, a wrinkle of the sheet, or the transportation of the sheet skewed is avoided. Consequently, if a containing number of stacked sheets in the cassette is increased and a warp in the sheets becomes so large that its influence on the transportation precision cannot be disregarded, various malfunctions caused by a warp can be avoided when the sheet is fed out and transported.

The rotatable subsidiary holding member can suppress a warp existing in the sheets reliably by holding the sheets as deep as the pickup rollers do so, or deeper.

Before the pickup rollers are separated from and feed out the uppermost sheet, the rotatable subsidiary rollers contact the uppermost sheet. Accordingly, the holding member is separated from the uppermost sheet. Therefore, the rotatable subsidiary holding member can hold the sheets without hindering an operation for feeding out by the pickup rollers.

The friction between the rotatable subsidiary holding member and the sheets can be suppressed. Therefore, the rotatable subsidiary holding member can hold the sheets without hindering an operation for feeding out by the pickup rollers.

On the uppermost sheet, the rotatable subsidiary holding member is arranged on the center portion as viewed in a direction of the rotation axis (first rotation axis, second rotation axis) common to the rotatable subsidiary holding member and the pickup rollers. Normally, since a warp of the sheets occurs at the center portion of the sheets, the warp can be suppressed effectively with the rotatable subsidiary holding member arranged in this manner.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet feeder comprising:

a cassette for containing a plurality of sheets stacked therein;

a holding member for holding the stacked sheets in the cassette from above;

at least one pickup roller arranged on a first rotation axis extending in a direction perpendicular to a transporting direction, in which an uppermost sheet is fed from the cassette and transported, said at least one pickup roller feeding and transporting the uppermost sheet while the pickup roller is kept in contact with the uppermost sheet during one rotation of the pickup roller; and a rotatable subsidiary holding member which: (i) is arranged on a second rotation axis extending in the direction perpendicular to the transporting direction, (ii) rotates in synchronization with a rotation of the pickup roller and in the same direction as the pickup roller rotates, (iii) contacts the uppermost sheet from above to hold a warp of the sheets during one rotation of the rotatable subsidiary holding member before the pickup roller contacts the uppermost sheet, and (iv) keeps contacting the uppermost sheet until after the pickup roller contacts the uppermost sheet.

2. The sheet feeder according to claim 1, wherein a distance between the second rotation axis of the rotatable subsidiary holding member and a surface of the rotatable subsidiary holding member which contacts the uppermost sheet is equal to or greater than a distance between the first rotation axis of the pickup roller and a surface of the pickup roller which contacts the uppermost sheet.

3. The sheet feeder according to claim 1, wherein the rotatable subsidiary holding member is separated from the uppermost sheet during one rotation of the rotatable subsidiary holding member before the pickup roller is separated from the uppermost sheet.

4. The sheet feeder according to claim 1, wherein the rotatable subsidiary holding member is made of a low-frictional material, and when the rotatable subsidiary holding member is in contact with the uppermost sheet, friction between the uppermost sheet and the rotatable subsidiary holding member is suppressed.

5. The sheet feeder according to claim 1, wherein:

two pickup rollers are arranged individually on both sides of the uppermost sheet as viewed in a direction of the first rotation axis, the first rotation axis and the second rotation axis are arranged identical with each other, and the rotatable subsidiary holding member is arranged between the two pickup rollers, so that the rotatable subsidiary holding member is arranged on a center portion of the uppermost sheet as viewed in a direction of the second rotation axis.

6. A sheet feeder comprising:

a cassette adapted to contain a plurality of sheets stacked in the cassette;

at least one pickup roller which feeds an uppermost sheet from the cassette by one rotation of the pickup roller while the pickup roller is kept in contact with the uppermost sheet; and a holding member which suppresses a warp of the uppermost sheet by contacting a central portion of the uppermost sheet, as viewed in a right angled direction to a sheet feeding direction in which the uppermost sheet is fed from the cassette, before the pickup roller contacts the uppermost sheet.

7. The sheet feeder according to claim 6, wherein the holding member includes a holding roller which rotates in synchronization with a rotation of the pickup roller and in a same direction of rotation as the pickup roller.

8. The sheet feeder according to claim 7, wherein a diameter of the holding roller is equal to or greater than a diameter of the pickup roller.

9. The sheet feeder according to claim 7, wherein the holding roller is made of synthetic resin.

10. The sheet feeder according to claim 6, wherein two pickup rollers are provided and arranged individually on both sides of the uppermost sheet in the right angled direction to the sheet feeding direction, and the holding member is arranged between the two pickup rollers.

11. The sheet feeder according to claim 6, wherein the holding member includes a cam.

12. The sheet feeder according to claim 11, wherein the cam contacts the uppermost sheet to hold the sheets by one rotation of the cam before the pickup roller contacts the uppermost sheet.

13. The sheet feeder according to claim 6, further comprising a transport guide which is arranged on a downstream side of the cassette, and which guides the sheet fed from the cassette in a direction perpendicular to the sheet feeding direction.

14. An image forming apparatus comprising:

an image forming unit which forms an image on a sheet;

a cassette adapted to contain a plurality of sheets stacked in the cassette;

at least one pickup roller which feeds an uppermost sheet from the cassette to the image forming unit by one rotation of the pickup roller while the pickup roller is kept in contact with the uppermost sheet; and a holding member which suppresses a warp of the uppermost sheet by contacting a central portion of the uppermost sheet, as viewed in a right angled direction to a sheet feeding direction in which the uppermost sheet is fed from the cassette, before the pickup roller contacts the uppermost sheet.

15. The image forming apparatus according to claim 14, wherein the holding member includes a holding roller which rotates in synchronization with a rotation of the pickup roller and in a same direction of rotation as the pickup roller.

16. The image forming apparatus according to claim 15, wherein a diameter of the holding roller is equal to or greater than a diameter of the pickup roller.

17. The image forming apparatus according to claim 14, further comprising a transport guide which is arranged in a downstream side of the cassette, and which guides the sheet fed from the cassette in a direction perpendicular to the sheet feeding direction.

18. A sheet feeder comprising:

a sheet stacker adapted to contain a plurality of sheets stacked in the sheet stacker;

two pickup rollers arranged on a rotation axis extending in a direction perpendicular to a transporting direction, in which the uppermost sheet is fed from the sheet stacker and transported, said pickup rollers feeding and transporting the uppermost sheet by one rotation of the pickup rollers while the pickup rollers are kept in contact with the uppermost sheet; and a rotatable subsidiary holding member which: (i) is arranged on the rotation axis between the pickup rollers and on a center portion of the uppermost sheet as viewed in a direction of the rotation axis, (ii) rotates in synchronization with the rotation of the pickup rollers and in a same direction of rotation as the pickup rollers, and (iii) contacts the uppermost sheet to suppress a warp of the sheets stacked in the sheet stacker by one rotation of the rotatable subsidiary holding member before the pickup rollers contact the uppermost sheet;

wherein a distance between the rotation axis and a surface of the rotatable subsidiary holding member which contacts the uppermost sheet is equal to or greater than a distance between the rotation axis and a surface of each of the pickup rollers which contacts the uppermost sheet.

19. The sheet feeder according to claim 18, wherein the surface of the rotatable subsidiary holding member which contacts the uppermost sheet is made of a low-frictional material, and when the surface is in contact with the uppermost sheet, friction between the uppermost sheet and the surface is suppressed.

20. A sheet feeder comprising:

a sheet stacker adapted to contain a plurality of sheets stacked in the sheet stacker;

two pickup rollers arranged on a rotation axis extending in a direction perpendicular to a transporting direction, in which the uppermost sheet is fed from the sheet stacker and transported, each of the pickup rollers including an outer circumferential surface which contacts and is separated from the uppermost sheet during one rotation of the pickup roller, said pickup rollers feeding and transporting the uppermost sheet by one rotation of the pickup rollers while each outer circumferential surface of the pickup rollers is kept in contact with the uppermost sheet, and each outer circumferential surface of the pickup rollers having a necessary length in a circumferential direction to transport the uppermost sheet from the sheet stacker to a position outside the sheet stacker; and a rotatable subsidiary holding member arranged on the rotation axis between the two pickup rollers, said rotatable subsidiary holding member including an outer circumferential surface which contacts and is separated from the uppermost sheet during one rotation of the rotatable subsidiary holding member, and said outer circumferential surface of the rotatable subsidiary holding member contacting the uppermost sheet to suppress a warp of the sheets stacked in the sheet stacker while the pickup rollers are kept in contact with the uppermost sheet.

21. The sheet feeder according to claim 20, wherein the rotatable subsidiary holding member is arranged on a center portion of the uppermost sheet as viewed in a direction of the rotation axis.

22. The sheet feeder according to claim 20, wherein the outer circumferential surface of each of the pickup rollers has an arc shape and includes a leading end placed at a front side as viewed in a rotating direction of the pickup rollers and a terminal end placed at a back side, and wherein the outer circumferential surface of the rotatable subsidiary holding member also has an arc shape and includes a leading end placed at a front side as viewed in a rotating direction of the rotatable subsidiary holding member and a terminal end placed at a back side.

23. The sheet feeder according to claim 22, wherein the rotatable subsidiary holding member rotates in synchronization with the rotation of the pickup rollers and in a same direction of rotation as the pickup rollers, and wherein the leading end of the rotatable subsidiary holding member is placed in front of the leading end of each pickup roller in the rotating direction of the pickup rollers and the rotatable subsidiary holding member.

24. The sheet feeder according to claim 22, wherein the rotatable subsidiary holding member is arranged on a center portion of the uppermost sheet as viewed in a direction of the rotation axis.

25. A method of feeding a plurality of sheets stacked in a sheet stacker comprising:

feeding an uppermost sheet from the sheet stacker and transporting the uppermost sheet by rotating two pickup rollers on a rotation axis extending in a direction perpendicular to a transporting direction, in which the uppermost sheet is fed from the sheet stacker and transported, said pickup rollers feeding and transporting the uppermost sheet by one rotation of the pickup rollers while the pickup rollers are kept in contact with the uppermost sheet; and suppressing a warp of the sheets stacked in the sheet stacker by rotating a rotatable subsidiary holding member on the rotation axis in synchronization with the rotation of the pickup rollers and in a same direction of rotation as the pickup rollers, said rotatable subsidiary holding member being arranged between the two pickup rollers and on a center portion of the uppermost sheet as viewed in a direction of the rotation axis, and said rotatable subsidiary holding member contacting the uppermost sheet to suppress the warp of the sheets stacked in the sheet stacker by one rotation of the rotatable subsidiary holding member before the pickup rollers contact the uppermost sheet;

wherein a distance between the rotation axis and a surface of the rotatable subsidiary holding member which contacts the uppermost sheet is equal to or greater than a distance between the rotation axis and a surface of each of the pickup rollers which contacts the uppermost sheet.

26. A method of feeding a plurality of sheets stacked in a sheet stacker comprising:

feeding an uppermost sheet from the sheet stacker and transporting the uppermost sheet by rotating two pickup rollers on a rotation axis extending in a direction perpendicular to a transporting direction, in which the uppermost sheet is fed from the sheet stacker and transported, each of the pickup rollers including an outer circumferential surface which contacts and is separated from the uppermost sheet during one rotation of the pickup roller, said pickup rollers feeding and transporting the uppermost sheet by one rotation of the pickup rollers while each outer circumferential surface is kept in contact with the uppermost sheet, and each outer circumferential surface of the pickup rollers having a necessary length in a circumferential direction to transport the uppermost sheet from the sheet stacker to a position outside the sheet stacker; and suppressing a warp of the sheet stacked in the sheet stacker by rotating on the rotation axis a rotatable subsidiary holding member arranged between the two pickup rollers, said rotatable subsidiary holding member including an outer circumferential surface which contacts and is separated from the uppermost sheet during one rotation of the rotatable subsidiary holding member, and said outer circumferential surface of the rotatable subsidiary holding member contacting the uppermost sheet to suppress the warp of the sheets stacked in the sheet stacker while the pickup rollers are kept in contact with the uppermost sheet.

* * * * *